US008607595B2

(12) United States Patent
Besikci et al.

(10) Patent No.: US 8,607,595 B2
(45) Date of Patent: Dec. 17, 2013

(54) WASHING MACHINE WITH CONTROL UNIT THAT IMPLEMENTS SPINNING PROFILE COMPRISING A LOOSENING STEP FOR FORMING SHALLOW CREASES

(76) Inventors: Aysegul Ayday Besikci, Istanbul (TR); Ebru Gungor, Istanbul (TR); Feryat Yildirim, Istanbul (TR)

( * ) Notice: Subject to any disclaimer, the term of this patent is extended or adjusted under 35 U.S.C. 154(b) by 947 days.

(21) Appl. No.: 12/675,785

(22) PCT Filed: Aug. 27, 2008

(86) PCT No.: PCT/EP2008/061176
§ 371 (c)(1),
(2), (4) Date: Mar. 1, 2010

(87) PCT Pub. No.: WO2009/027414
PCT Pub. Date: Mar. 5, 2009

(65) Prior Publication Data
US 2010/0300156 A1 Dec. 2, 2010

(30) Foreign Application Priority Data
Aug. 31, 2007 (TR) ..... a 2007 06039

(51) Int. Cl.
*D06F 35/00* (2006.01)

(52) U.S. Cl.
USPC ..... 68/12.12; 68/24

(58) Field of Classification Search
CPC ..... D06F 35/007
USPC ..... 68/12.12, 12.14, 24; 8/158–159
See application file for complete search history.

(56) References Cited

U.S. PATENT DOCUMENTS

| | | | | |
|---|---|---|---|---|
| 5,207,764 | A * | 5/1993 | Akabane et al. | 68/20 |
| 7,446,500 | B2 * | 11/2008 | Schulze et al. | 318/772 |
| 2005/0000033 | A1 * | 1/2005 | Park et al. | 8/159 |
| 2005/0108830 | A1 * | 5/2005 | Park et al. | 8/158 |
| 2007/0107473 | A1 * | 5/2007 | Park | 68/12.14 |
| 2008/0083132 | A1 * | 4/2008 | Schaub et al. | 34/318 |
| 2010/0005598 | A1 * | 1/2010 | Jung | 8/159 |

FOREIGN PATENT DOCUMENTS

| | | | |
|---|---|---|---|
| DE | 4206135 | A1 * | 9/1993 |
| JP | 61050593 | A * | 3/1986 |

OTHER PUBLICATIONS

Machine translation of DE 4206135 A1, no date.*

* cited by examiner

*Primary Examiner* — Joseph L Perrin
(74) *Attorney, Agent, or Firm* — Venable, Campillo, Logan & Meaney PC

(57) ABSTRACT

A washing machine having a control unit that implements a spinning profile wherein a loosening step is employed by stopping the drum at specific intervals wherein wrinkles formed in clothes are shallow creases that are easy to iron out.

7 Claims, 2 Drawing Sheets

Figure 1:
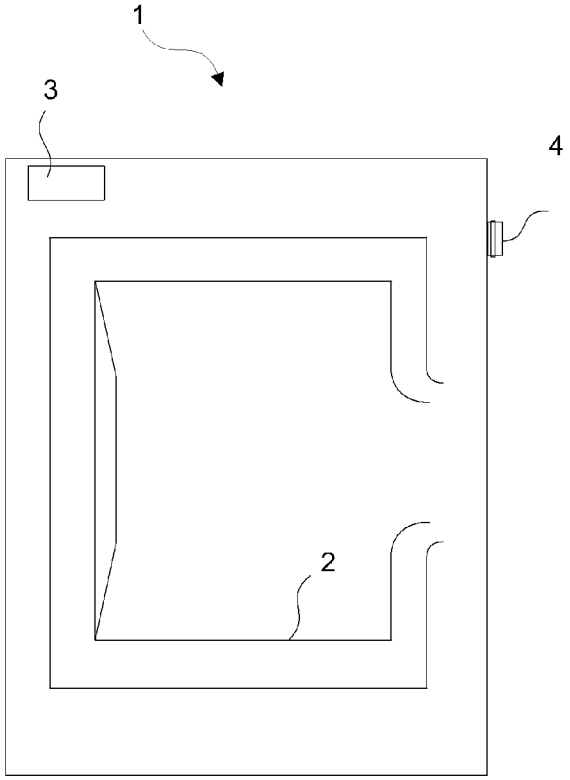
Fig. 1 PRIOR ART

WASHING MACHINE WITH CONTROL UNIT THAT IMPLEMENTS SPINNING PROFILE COMPRISING A LOOSENING STEP FOR FORMING SHALLOW CREASES

The present invention relates to a washing machine.

In washing machines, the washing program is comprised of pre-wash, main washing, rinsing and spinning steps. In washing machines, wrinkling is an important problem that is seen as a result of the washing process in particularly tightly woven cotton fabrics. Most of the wrinkling is formed and/or gets deeper during the spinning step because during the spinning step laundry adheres to the wall of the drum and increasing wrinkling is observed depending on the acceleration of the spinning speed.

In order to solve the above mentioned problem, solutions have been developed in the conventional art aimed at reducing the wrinkles in the spinning profile.

In state of the art Great Britain Patent Application No GB2272274, a washing machine is explained comprising an operational profile having a loosening step during which the drum is alternately stopped and driven at a predetermined rotational speed lower than the rotational speed of spinning for distributing the laundry thereby detaching laundry from the inward wall of its drum.

In another state of the art document, the European Patent Application No EP0796942, the drum is rotated in forward and backward directions thereby performing a loosening cycle in which laundry is uniformly distributed or dispersed in the drum.

Another state of the art document is the German Patent Application No DE4206135. In the washing machine explained in this document, the speed and duration of the loosening and spinning steps are controlled in accordance with the washing parameters such as load and water intake for decreasing the wrinkles that may form in the clothes.

However, in the above explained implementations, since the laundry adhering to the wall of the drum fall down and heap up all in the same way, that is the laundry at the bottom staying always at the bottom and the ones staying at the top to be always at the top when the drum stops or slows down, whereby the formed wrinkles are few but deep and are hard to iron out.

The aim of the present invention is the realization of a washing machine having a spinning profile wherein the formed wrinkles are easy to iron out.

The washing machine realized in order to attain the aim of the present invention, explicated in the first claim and the respective claims thereof, comprises a control unit that implements a spinning profile wherein a loosening step is employed by stopping the drum at specific intervals.

In the loosening step, the drum is rotated at least once in clockwise direction and at least once in counterclockwise direction for different angles. That is the drum is rotated for example about 120° degrees in one direction and 270° degrees in the other direction in the loosening step. In other words, the drum is rotated in the loosening step such that the duration of the rotation in one direction is not equal to the duration of rotation in the other direction. Consequently, the laundry adhering to the drum wall is prevented from falling so as to stay in the same place during the loosening step and to be distributed, thus the formed wrinkles are easy to iron out.

In an embodiment of the present invention, more than one loosening step is implemented during the spinning process. In the preferred version of this embodiment, if the long rotation is performed in clockwise direction in one of the consecutive loosening steps, then the next one is performed in the reverse direction. Thus the laundry is distributed more effectively.

In an embodiment of the present invention, the drum is rotated for a longer time in one direction, for example about 60 sec. and a shorter time in the other direction, for example 30 sec.

In an embodiment of the present invention, the spinning speed is increased gradually after each loosening step to be some amount higher.

In an embodiment of the present invention, the spinning profile providing the wrinkles to be less deep is implemented by the control unit each time the washing machine is operated. Thus, in every spinning process the wrinkles are made less deep.

In another embodiment of the present invention, the spinning profile that maintains the wrinkles to be less deep is operated by the user pressing a button. Thus, instead of using the spinning profile for making the wrinkles less deep every time it is activated, it is enabled that the profile is put into use only in the washing programs required by the user.

By means of the present invention, the wrinkles formed in the laundry are maintained to be easy to iron out wrinkles.

The washing machine realized in order to attain the aim of the present invention is illustrated in the attached figures, where:

FIG. 1—is the schematic view of a washing machine.

Figure 2:
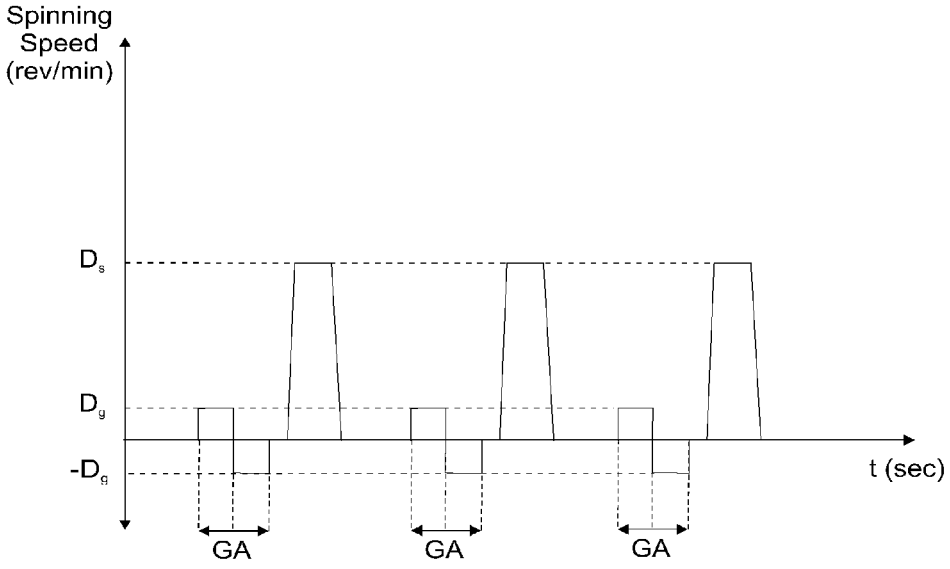

FIG. 2—is the graph of the spinning profile used in the prior technique.

Figure 3:
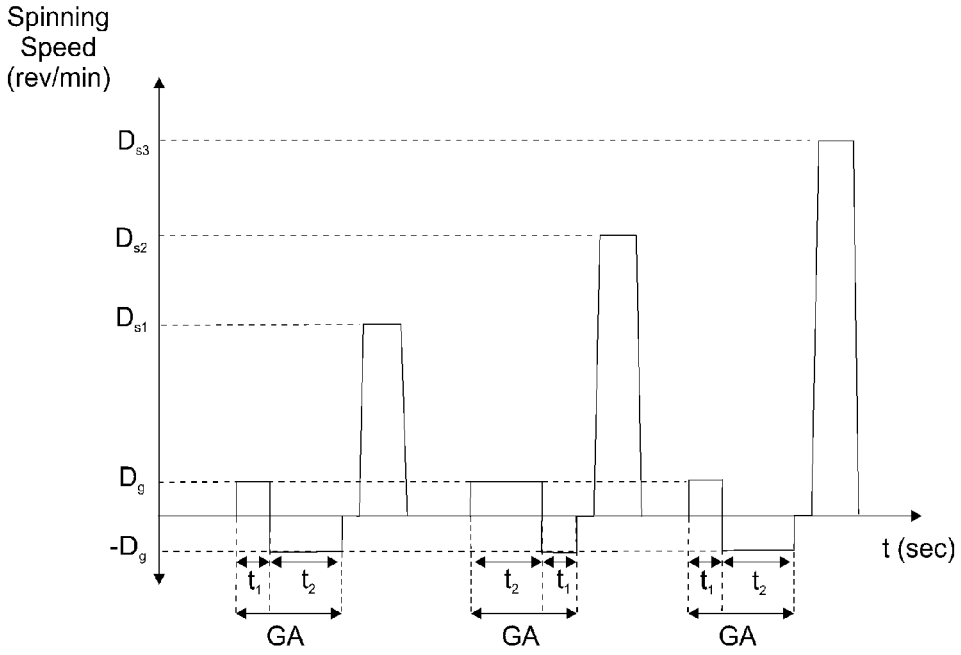

FIG. 3—is the graph of the spinning profile used in an embodiment of the present invention.

The elements illustrated in the figures are numbered as follows:

1. Washing machine
2. Drum
3. Control unit
4. Button

The washing machine (1) of the present invention comprises a drum (2) wherein the laundry to be washed is emplaced and a control unit (3) that implements a spinning profile comprising a loosening step (GA) wherein the drum (2) is slowed down at certain intervals to be rotated at least once in clockwise direction and least once in counterclockwise direction with a speed ($D_g$) lower than the spinning speed ($D_s$) for different angles ($\alpha$, $\beta$) from each other during the spinning process (FIG. 1).

When the spinning process starts, after rotating the drum (2) in the spinning speed for a predetermined time period, the control unit (3) stops the drum (2) by sending a command. Afterwards, the loosening step (GA) is implemented whereby the drum is rotated for an angle ($\alpha$) in one direction by a command again delivered from the control unit (3). In the meantime, the laundry adhering to the drum (2) wall during the spinning cycle falls down separating from the place adhered to. Then the drum (2) is rotated in the reverse direction, this time for a different angle ($\beta$) in accordance with the command received from the control unit (3). During this time, the laundry loosens and turns in the drum (2) and falls down in a layout at least partially different than the previous one, that is, at least some of the laundry previously at the bottom is now at the top. Since the angles of the two rotations are different from each other, the falling laundry in the two rotations does not stay at the same position but are mingled.

In an embodiment of the present invention, in the loosening step the drum (2) is rotated at least once clockwise and at least once counterclockwise for durations ($t_1$, $t_2$) that are not equal to each other.

In an embodiment of the present invention, the control unit (3) implements more than one loosening step (GA) during the spinning process. In the preferred version of this embodiment, if the short time rotation ($\alpha/t_1$) is performed in clockwise direction in one of the loosening steps (GA), it is performed in the reverse direction in the next one. Respectively, the long time rotation ($\beta/t_2$) in counterclockwise direction in the first loosening step (GA) is in clockwise direction in the next loosening step (GA). Thus, the laundry can be distributed more effectively.

In an embodiment of the present invention, the spinning speed ($D_{s1}$) is increased ($D_{s2}$, $D_{s3}$, . . . ) gradually after each loosening step (GA). Thus, the spinning process can be completed more effectively in a short period of time.

In an embodiment of the present invention, every time the washing machine (1) is operated, the control unit (3) implements the said spinning profile. Thus, this spinning profile providing the wrinkles to be easily ironed out is implemented in all the washing processes without requiring any intervention of the user.

In an embodiment of the present invention, the washing machine (1) comprises a button (4) that enables the control unit (3) to activate the said spinning profile. When the washing machine (1) is operated, the button (4) is triggered by the user; thus providing the control unit (3) to activate the said spinning profile that provides the wrinkles to be less deep. Consequently in every washing process, this spinning profile is not implemented but only when the user so desires.

By the spinning profile implemented by means of the control unit (3) included in the washing machine (1) of the present invention, laundry forming wrinkles during the washing process to a depth that can be easily ironed out, has been achieved.

The invention claimed is:

1. A washing machine (1) that comprises a drum (2) wherein the laundry to be washed is emplaced and a control unit (3) that implements a spinning profile comprising a loosening step (GA) wherein the drum (2) is slowed down at certain intervals to be rotated at least once in clockwise direction and least once in counterclockwise direction with a speed ($D_g$) lower than the spinning speed ($D_s$) and with the control unit (3) that rotates the drum (2) clockwise and counterclockwise for different angles ($\alpha$, $\beta$) from each other in the loosening step (GA) wherein the control unit implements a spinning profile comprising more than one loosening step (GA) and wherein if a long rotation ($\alpha/t_1$) in clockwise direction is performed in one of the consecutive loosening steps (GA), then the next one is performed in the counterclockwise direction.

2. The washing machine (1) as in claim 1, wherein the control unit (3) rotates the drum (2) at least once clockwise and at least once counterclockwise for durations ($t_1$, $t_2$) that are not equal to each other.

3. The washing machine machine (1) as in claim 2, further comprising a button (4) that enables the spinning profile to be activated by the control unit (3).

4. The washing machine (1) as in claim 1, wherein the control unit (3) implements a spinning profile wherein the spinning speed ($D_{s1}$) is increased ($D_{s2}$, $D_{s3}$, . . . ) gradually after each loosening step (GA).

5. The washing machine (1) as in claim 4, further comprising a button (4) that enables the spinning profile to be activated by the control unit (3).

6. The washing machine machine (1) as in claim 1, further comprising a button (4) that enables the spinning profile to be activated by the control unit (3).

7. The washing machine (1) as in claim 1, wherein the more than one loosening step (GA) are of durations are prevented from falling from a wall of the drum.

* * * * *